US008584270B2

(12) United States Patent
Rosser

(10) Patent No.: US 8,584,270 B2
(45) Date of Patent: Nov. 19, 2013

(54) TOILET EQUIPMENT

(76) Inventor: Glyn David Rosser, Reading (GB)

( * ) Notice: Subject to any disclaimer, the term of this patent is extended or adjusted under 35 U.S.C. 154(b) by 0 days.

(21) Appl. No.: 13/112,104

(22) Filed: May 20, 2011

(65) Prior Publication Data

US 2011/0214228 A1 Sep. 8, 2011

Related U.S. Application Data

(63) Continuation-in-part of application No. PCT/GB2009/002711, filed on Nov. 20, 2009.

(30) Foreign Application Priority Data

Nov. 21, 2008 (GB) ..... 0821283.9

(51) Int. Cl.
*A47K 11/04* (2006.01)

(52) U.S. Cl.
USPC ..... 4/483

(58) Field of Classification Search
USPC ..... 4/483, 449, 479
See application file for complete search history.

(56) References Cited

U.S. PATENT DOCUMENTS

| | | | | |
|---|---|---|---|---|
| 1,575,131 | A * | 3/1926 | Schumacher | 4/460 |
| 3,657,745 | A * | 4/1972 | Hickman | 4/483 |
| 4,193,142 | A * | 3/1980 | Henningfield | 4/483 |
| 4,641,383 | A * | 2/1987 | Sargent et al. | 4/323 |

FOREIGN PATENT DOCUMENTS

| | | | |
|---|---|---|---|
| DE | 2615883 | | 10/1977 |
| DE | 198 37 480 | A1 * | 4/2000 |
| FR | 1514151 | | 1/1968 |
| FR | 2882644 | | 9/2006 |
| WO | WO 95/22275 | | 8/1995 |
| WO | WO 2010/0737027 | | 7/2010 |

OTHER PUBLICATIONS

International search report (EPO) dated Feb. 19, 2010 and written Opinion for PCT/GB2009/00271.
Abbreviated Internet page: http://www.merriam-webster.com/dictionary/potty, Aug. 9, 2012.
Page 894 of Merriam-Webster New Collegiate Dictionary, Published by Merriam-Webster In 1981.
UK patent office search report for GB0821283.9 dated Feb. 18, 2009.
www.worldobaths.co.uk/p-and-s-traps. date unknown, Jul. 25, 2012.
Espacenet Bibliographic data DE19837480 (Schumacher), Apr. 13, 2000.
(Machine) translation of DE19837480, Apr. 13, 2000.
www/pourty.com/uk/, 'The Pourty Potty,' pp. 1-3, seen Jul. 2011 Date unknown.
Abbreviated Internet p. 2: http://www.merriam-webster.com/dictionary/potty, Aug. 9, 2012.

* cited by examiner

*Primary Examiner* — Lori Baker
(74) *Attorney, Agent, or Firm* — Robert W. J. Usher

(57) ABSTRACT

A child's potty (10) comprises a bowl (12) within a substantially continuous surrounding skirt (40), seat portions (16) being formed on the rim of the bowl between the bowl and the skirt, and a raised backrest (30) at the rear of the potty, and a discharge spout (20) extending from the bowl under the backrest to an outlet (22) at the rear of the potty, to allow the potty to be emptied hygienically without contamination of the sides and seat portions.

24 Claims, 6 Drawing Sheets

TOILET EQUIPMENT

RELATED APPLICATION

This application is a continuation-in-part application filed under 35 USC 120 of International Application No. PCT/GB2009/002711, filed 20 Nov. 2009 (20.11.2009.

BACKGROUND OF THE INVENTION

This invention relates to toilet equipment, more specifically to a chamber pot or potty, especially a potty for use by a young child. Numerous terms may be used to designate such portable containers for the reception of waste matter, specifically urine and stools, eliminated by humans, but for convenience the term "potty" will be used herein to refer to this general class of portable toilet bowl, since this term is most commonly used in the context of infant toilet training and management, where this invention has particular application.

A simple standard potty consists of a bowl supported in a stable configuration, for example on a broad flat base, or by a dependent surrounding skirt which has a level lower edge forming a more or less continuous support around the bowl, which is contained within the skirt. For use by a child, the upper rim of the bowl may be made broad to serve as a seat. After a person has used the potty, it needs first to be carefully carried to a disposal point, such as a conventional flushable toilet (water closet). The toilet lid and seat are then lifted if they are not already raised, and the contents of the potty are tipped into the toilet bowl, which is then flushed to carry away the waste. Care must be taken to avoid spillage, and even so the fluid contents of the potty are likely to run over the seat and wet the outside, requiring such further hygienic rinsing and washing as may be necessary; but completely hygienic handling at all times cannot be assured. Further, young children are curious about their bodily waste and have little or no sense of hygiene and commonly have their fingers in contact with the outside surfaces of the potty, and in their mouths, according to their age or mental capacity.

While parents and carers know the importance of hygiene, it is no easy task to ensure optimum cleanliness. The present invention has for an object to provide a potty in which that task is made easier.

SUMMARY OF THE INVENTION

According to one aspect of the present invention, there is provided a potty comprising a bowl, a seat, a backrest extending to a height above the seat, and a rearward discharge spout extending from the bowl under the backrest.

The discharge spout permits the potty to be emptied by tilting or tipping it backwardly above a waste receptacle, such as a flush toilet bowl, without the waste wetting or contacting the potty seat in any way, thereby substantially improving the hygiene of the disposal operation.

It will be understood that the location of the backrest defines the front and back of the potty for the purposes of this specification.

The potty preferably comprises a base on which it may be stably set down for use by a child for toilet purposes, but it is also possible that the potty may be adapted to be held in a separate support which does not demand that the potty be stable when separated from such support. A preferred base is formed by the lowermost edge of a skirt around the bowl. Such a skirt may depend from the rim of the bowl and may surround the bowl continuously or discontinuously.

When the potty is oriented for use, either freely set down on its base or in its support, the bowl is positioned below the seat to catch the child's eliminated waste. The backrest and seat are of course adapted to a child's size range and act as such when a child sits on the potty. In the sitting position constrained by the backrest and seat, the bowl is under the child and the discharge spout terminates in a discharge outlet located behind the child's back, on the far side of the backrest, well away from the child's sight and reach.

Further advantageous and preferred features of the invention will be apparent from the following description and appended claims and drawings.

Advantageously, the discharge spout outlet is higher than the height of the bowl, and in particular higher than the height of the seat. This is to assist the avoidance of spillage by effluent slopping out of the discharge pipe when the potty is being carried to a WC for emptying, since the person carrying the potty can most readily watch the rim of the bowl and the seat during this process. Preferably, the discharge spout is an upwardly directed tubular conduit, rising from the bowl up to a discharge outlet, at which the spout terminates in a short lower pouring lip to eliminate, reduce or control dripping from the outlet. In one embodiment, the conduit forming the discharge spout has, to its lower part adjacent the discharge outlet, upper and underneath surfaces leading to the lower pouring lip, both of which are exposed and slightly downwardly inclined at their terminal portions towards the lip, at least when the potty is tilted backwardly for the discharge of waste. In a second embodiment, the discharge spout extends upwardly until it reaches the final pouring lip, and its lower exterior surface is not exposed except at that final lip. In this way, the risk of fluid waste running down the outside of the discharge spout after emptying the potty is minimised, and external contamination of the potty more easily avoided.

The discharge pipe is suitably of a rounded section, which may be a broad oval shape of sufficient size to allow for quick cleaning and access by hand. Suitable dimensions may be between about 100 mm and 140 mm on the long axis, and between about 80 mm and 95 mm on the short axis, at the narrowest parts of the discharge spout. Larger or smaller dimensions are possible, according to the desired compromise between free flow of effluent and ease of manual access which require a relatively broad spout, and control of the discharge on emptying and limitation of access by a child sitting on the potty which require a relatively narrow spout.

The backrest may include a hand grip above the discharge spout, facilitating hygienic handling of the potty during emptying. This hand grip may be formed only in the rear of the backrest, that is to say the part facing away from the bowl and seat of the potty. The hand grip may comprise a recess in the backrest forming a finger hold.

A hand grip may also be provided at the front of the potty. A suitable hand grip at the front is formed in the outside of a front skirt to the bowl. This hand grip may comprise a recess forming a finger hold.

The potty may also comprise a skirt on each side of the backrest extending rearwardly on each side of the discharge spout. In addition, the backrest may have a concave front surface, when viewed in plan. Thus the sides of the backrest may reach somewhat forwardly on either side of a child sitting on the potty, both these features making it more difficult for a seated child to twist and lean around the side of the backrest and reach towards the discharge spout.

The seat may be formed on or above the rim of the bowl, at least one seat region being located on each side of the bowl, forward of the backrest. A seat region may comprise a flattened, upwardly facing and generally horizontal area of the rim of the bowl, or alternatively may comprise a raised area higher than the rim of the bowl. The seat may be interrupted at the front of the potty by a raised shield portion extending upwardly from the bowl. The sides of the bowl, other than in the region of the rearward discharge spout, may be shaped so as to hinder or prevent spillage or slopping of waste from the bowl over the seat of the potty, by making them deep and steep.

The potty is preferably formed in one piece, and is suitably moulded of plastics material. There may be smooth transitions in the surface contours from bowl to seat and to backrest. A smooth, glossy surface, and absence of crevices, will assist cleanliness and hygiene.

BRIEF DESCRIPTION OF THE DRAWINGS

Two embodiments of the invention are illustrated by way of example in the accompanying drawings, in which:—

DETAILED DESCRIPTION OF THE INVENTION

Figure 1:
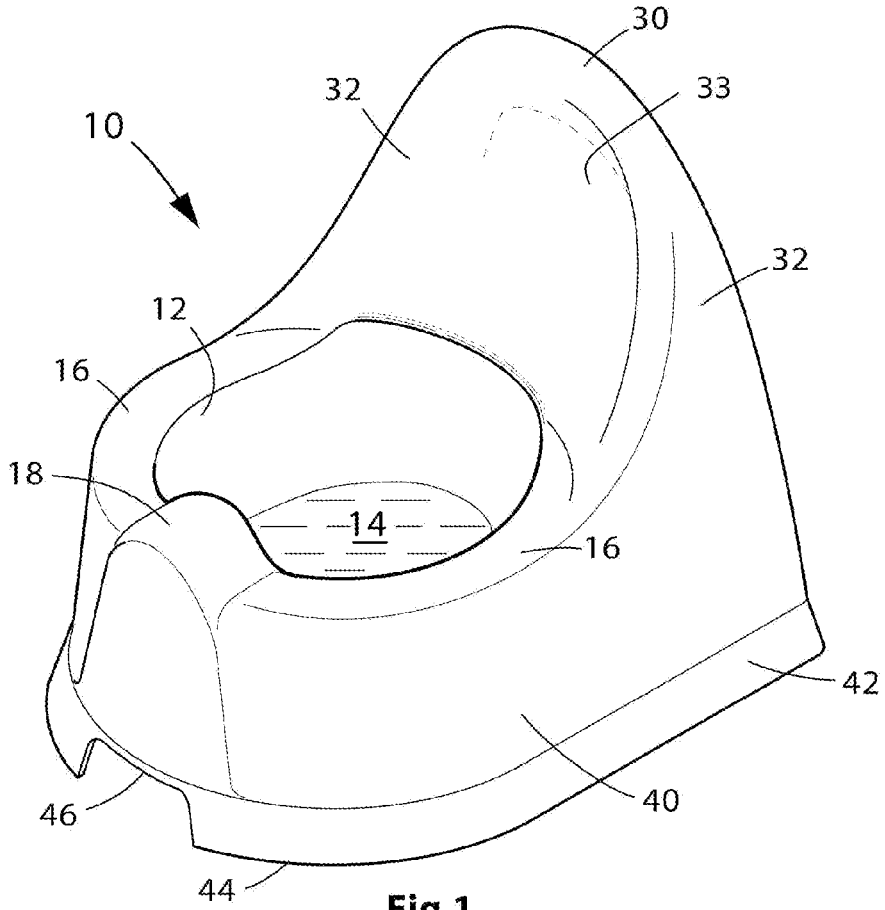
FIG. 1 is an isometric view of a potty in accordance with a first embodiment of the invention from a point above, in front and to one side of the potty.
Figure 2:
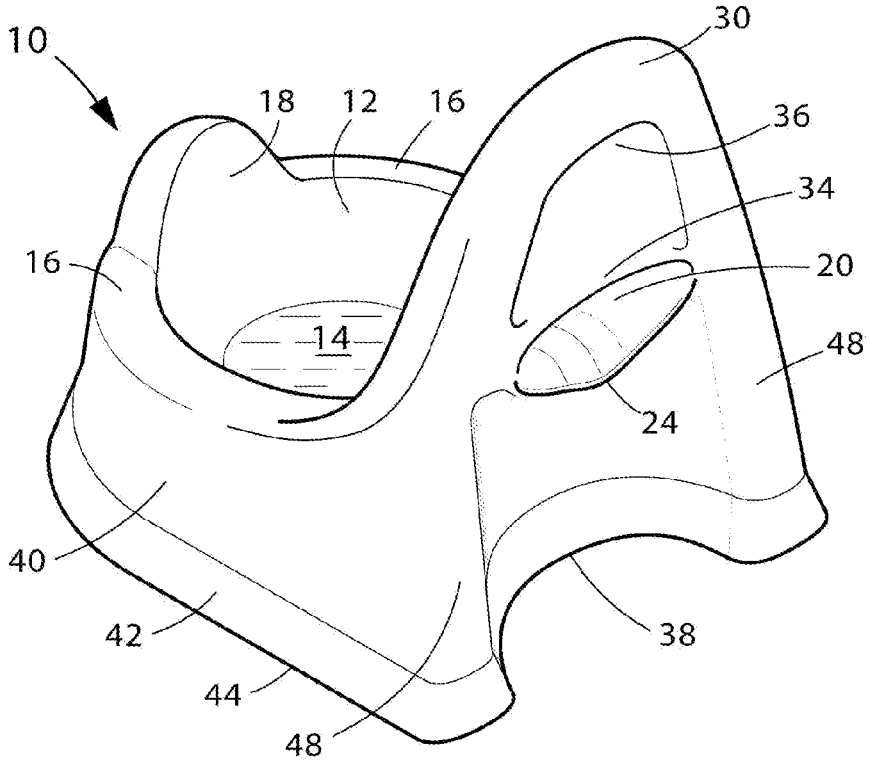
FIG. 2 is a similar view of the same potty from a more rearward viewpoint.

In FIGS. 1 to 6 of the drawings, a child's potty generally designated 10 is formed in one piece as a moulded plastics product.

A bowl 12 contains liquid waste 14. The bowl is provided with steep sides, near vertical towards the upper rim of the bowl, except towards the back of the bowl where rearwardly directed discharge spout 20 rises from the bowl to its outlet 22 at the back of the potty behind backrest 30.

The upper rim of bowl 12 is flattened on either side of the potty to form two opposite seat portions 16, but at the rear of the bowl the upper rim merges smoothly into the front of the backrest 30, while at the front of the bowl a portion of the rim is raised to form a shield 18 to assist in prevent urine from being projected forwards out of the bowl by a child sitting on the seat.

A continuous skirt 40 surrounds the bowl 12. This skirt extends downwardly from the seat portions 16 of the rim of the bowl on either side, and below the shield portion 18 at the front, and below the backrest 30 at the rear of the potty. A lower portion of the skirt 40 around the potty is splayed out to form a foot 42. The lowermost edge 44 of the skirt, which is the termination of the foot 42, follows a substantially planar configuration and forms a stable base on which the potty can be set down on a flat surface. The edge of 44 is lower than the lowest part of the bowl, so that the bowl is supported, dependent from its upper rim, within the skirt 40, clear of any flat surface on which the potty may be placed.

Figure 3:
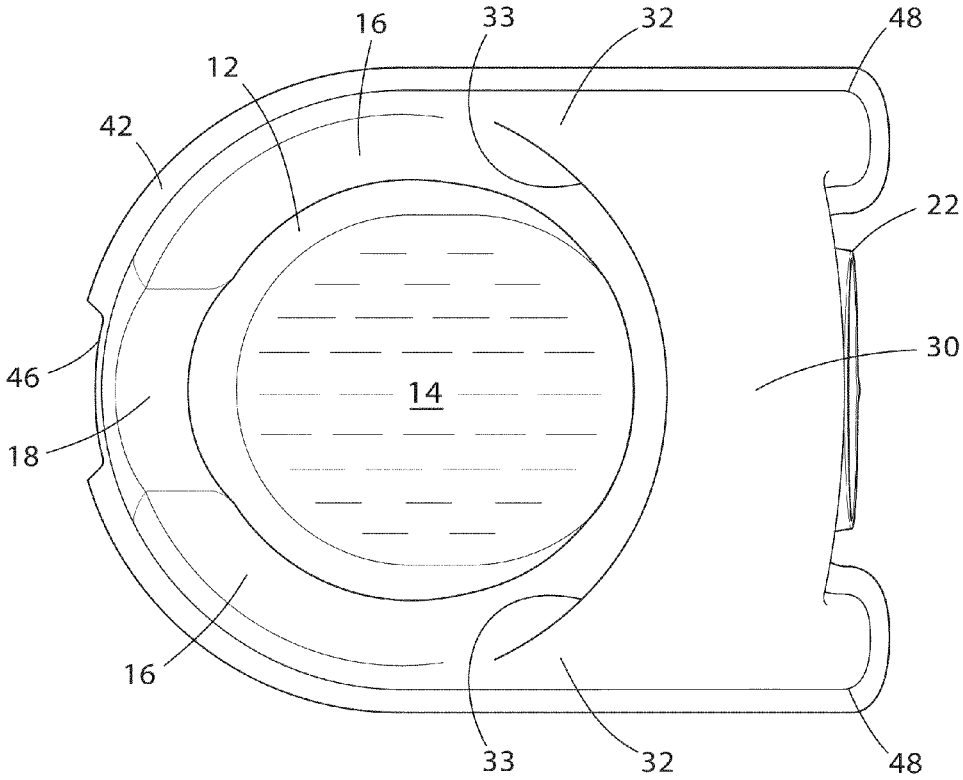
FIG. 3 is a plan view of the potty.
Figure 4:
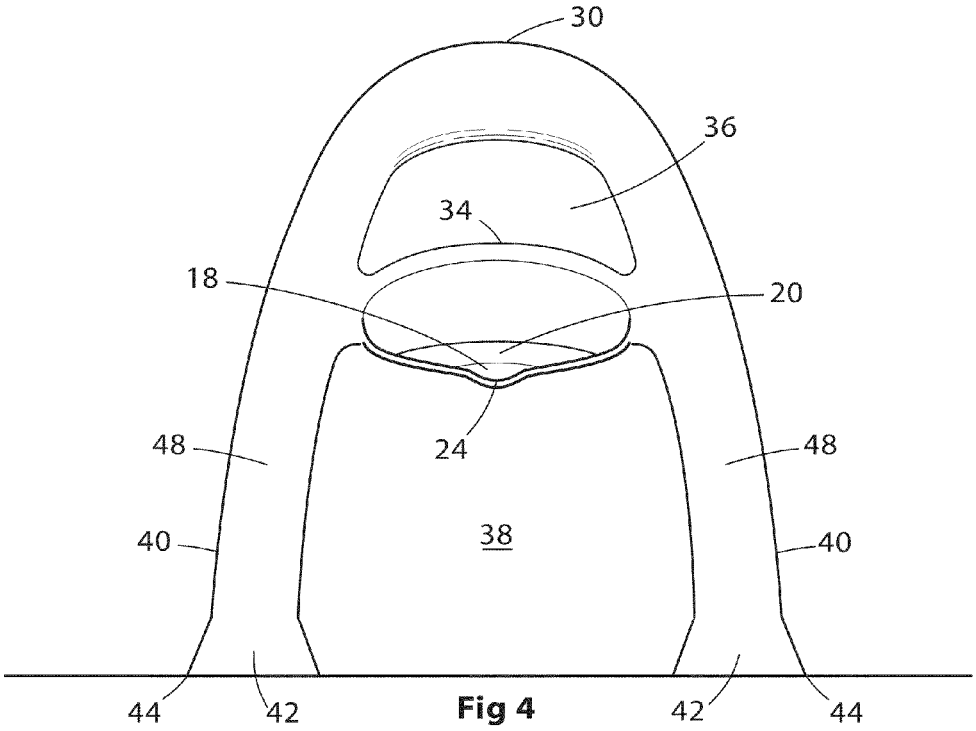
FIG. 4 is a rear view.

The backrest 30 has side portions 32 which extend forwardly towards the seat portions 16 on either side of the bowl, so that the backrest has a concave front surface 33 when viewed in plan (FIG. 3).

Figure 5:
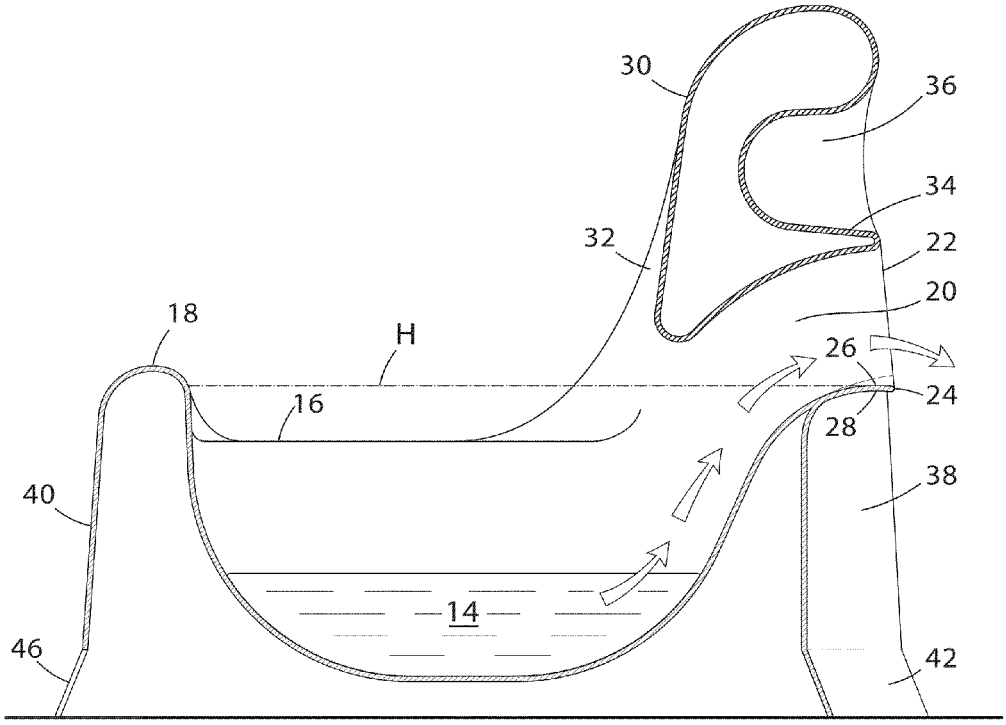
FIG. 5 is a side view, in longitudinal cross section.
Figure 6:
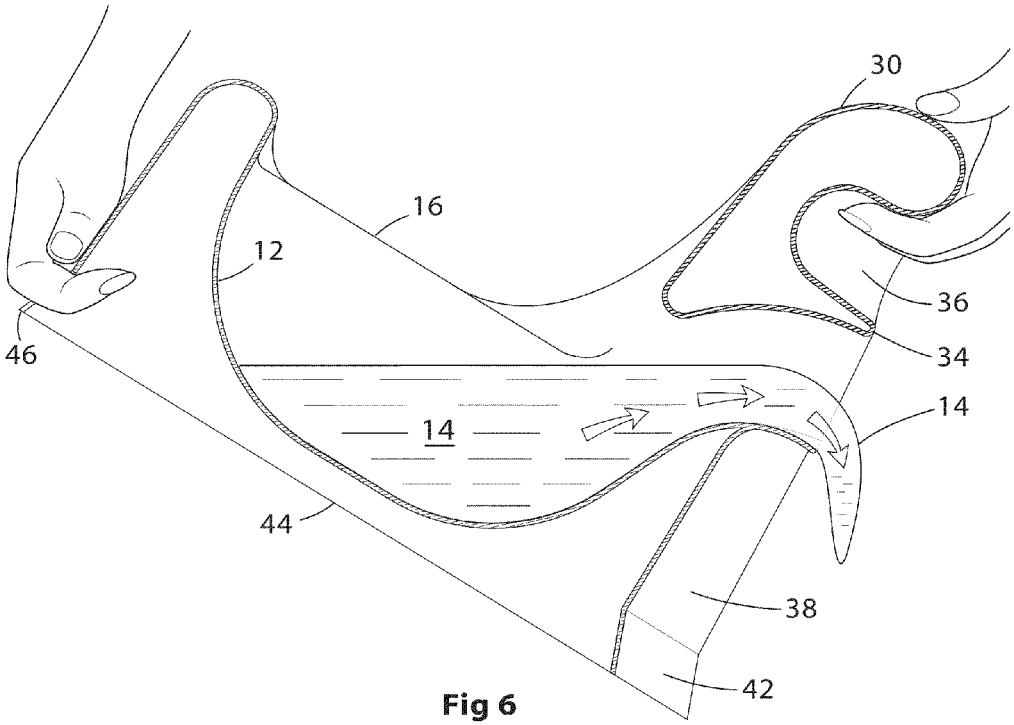
FIG. 6 shows the same cross section as FIG. 5, but the potty being lifted and tilted backwards to discharge waste.

The backrest extends to a substantial height above the seat, and discharge spout 20 rises from the bowl 12 below the backrest and passes under the backrest to outlet 22 at a height H above the level of the seat portions 16, which are the lowest parts of the upper rim of the bowl 12. The outlet is angled slightly upwardly, while the lower part of the spout conduit terminates in a downwardly inclined lower pouring lip 24, which has an upper surface 26 and an underneath surface 28 leading towards it, and these surfaces are suitably substantially horizontal or, as illustrated in FIG. 5, slightly downwardly inclined to reduce the risk of liquid poured from the spout running around the pouring lip and back down the outside of the potty at the rear.

The rear surface of the backrest 30 is formed with a hand grip provided by an upper recess 36 forming a finger hold (FIGS. 5, 6), and a protective dividing member 34 separates this upper recess from the discharge spout 20 below it. This dividing member provides some protection for the hand, shielding it against splashes from the spout when the potty is emptied.

A second hand grip at the front of the potty is provided by a recess 46 in the foot 42 of the skirt 40, forming a finger hold below the shield portion 18.

The rear of the potty is also formed with a lower recess 38 below the outlet 22, between rearward extensions 48 of skirt 40. The open outlet 22 of spout 20 accordingly lies above recess 38, between the rearward side extensions 48 and the side portions 32 of the backrest and the rearward skirt extensions 48 effectively shield the outlet 22 from a child sitting on the potty.

For emptying, the potty is carried to a suitable waste disposal point, such as a flushable WC, and tilted backwards (FIG. 6) while being held by an adult with two hands in the respective hand grips 36,46. During this process, the seat of the potty in particular, and the sides too, are kept free of contamination by the liquid waste 14, contributing greatly to improved hygiene in subsequent use of the potty. The configuration of the spout outlet ensures that waste can be poured into a disposal receptacle with a reduced risk of spillage or contamination of the seat rim and outside surfaces of the potty, in contrast to conventional potties which are prone to contamination of those areas in contact with the user as effluent fluid clings to the potty sides and seat and does not easily discharge in a fully controlled manner.

In the second embodiment of the invention shown in FIGS. 7 to 12 of the drawings, a child's potty generally designated 110 is also formed in one piece as a moulded plastics product. Except as distinctly pointed out in this description or as shown in the drawings, potties 10 and 110 of the two embodiments of the invention correspond, and the description of the first embodiment applies equally to the second. Parts which are substantially unchanged between the two embodiments are given the same reference numerals in each.

Figure 7:
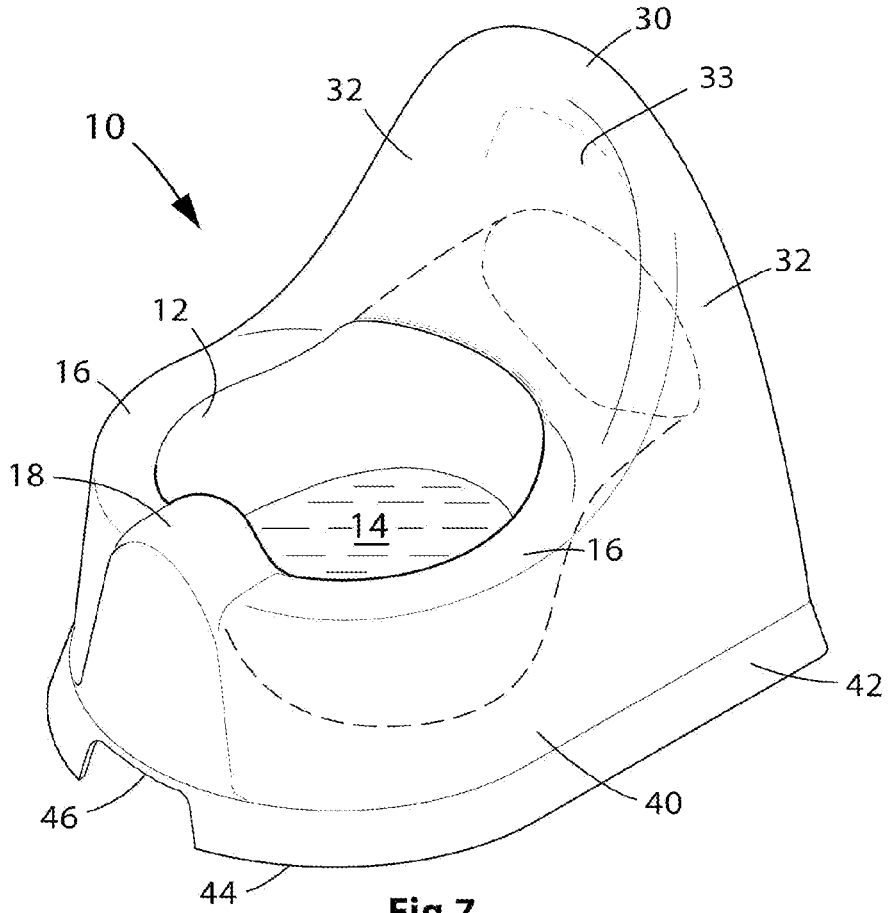
FIGS. 7 to 12 are corresponding views of a potty in accordance with a second embodiment of the invention.
Figure 8:
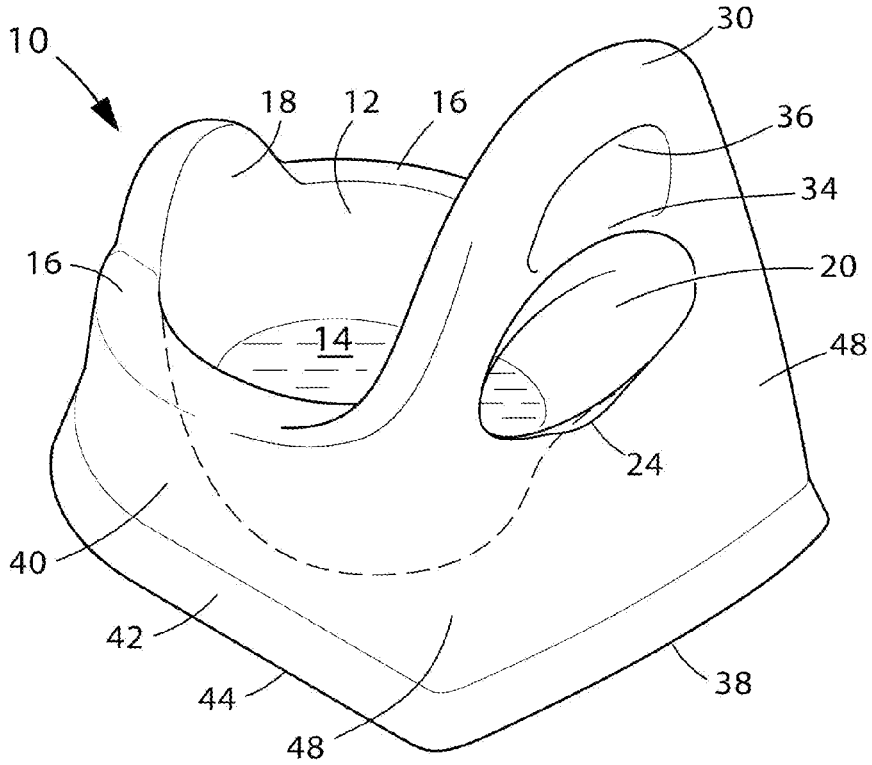

When seen from the front, as in FIG. 7, the potty 110 is substantially identical to the potty 10 as seen in FIG. 1. It comprises a bowl 12 for containing liquid waste 14. Towards the back of the bowl rearwardly directed discharge spout 120 rises from the bowl to its outlet 122 at the back of the potty behind backrest 130.

The upper rim of bowl 12 merges at the rear of the bowl smoothly into the front of the backrest 130. Dashed lines in FIG. 7 indicate the extent of the bowl 12, rearwardly directed discharge spout 120 and discharge outlet 122 where they are not visible in this view inside and behind the potty.

A continuous skirt 140 surrounds the bowl 12. At the front and sides of potty 110, this skirt is the same as skirt 40 in FIGS. 1 through 6, but it has a different shape at the rear of the potty. It still provides a stable base for the potty by means of its lowermost edge 144, which is the termination of the outwardly splayed foot portion 142 of the skirt 140.

Figure 9:
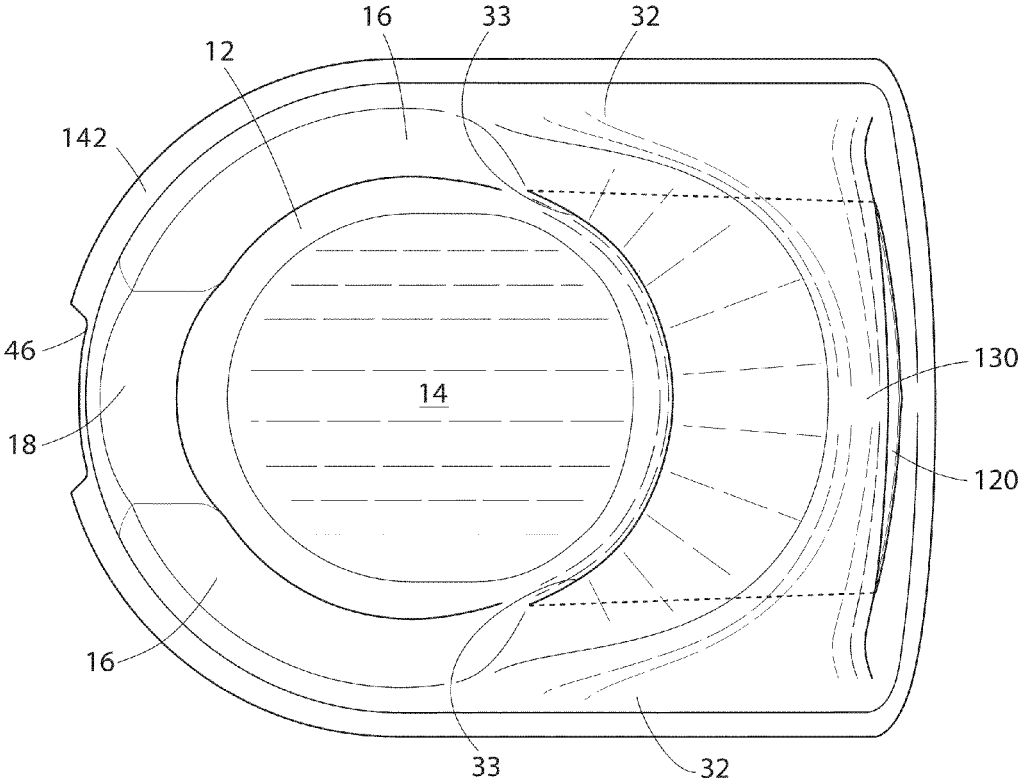
Figure 10:
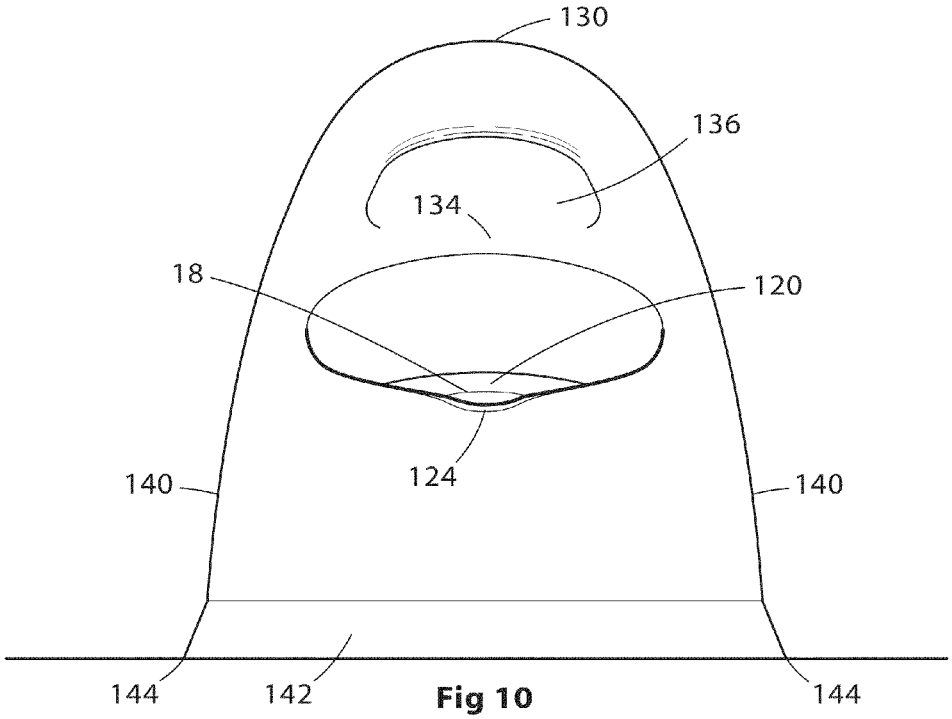

The backrest 130 again has side portions 32 which extend forwardly towards the seat portions 16 on either side of the bowl, so that the backrest has a concave front surface 33 when viewed in plan (FIG. 9).

Discharge spout 120 rises from the bowl 12 below the backrest 130 and passes as a tubular conduit under the backrest to discharge outlet 122 at a height H above the level of the seat portions 16. The spout is directed generally upwardly throughout its length. It terminates in a downwardly inclined lower pouring lip 124.

Figure 11:
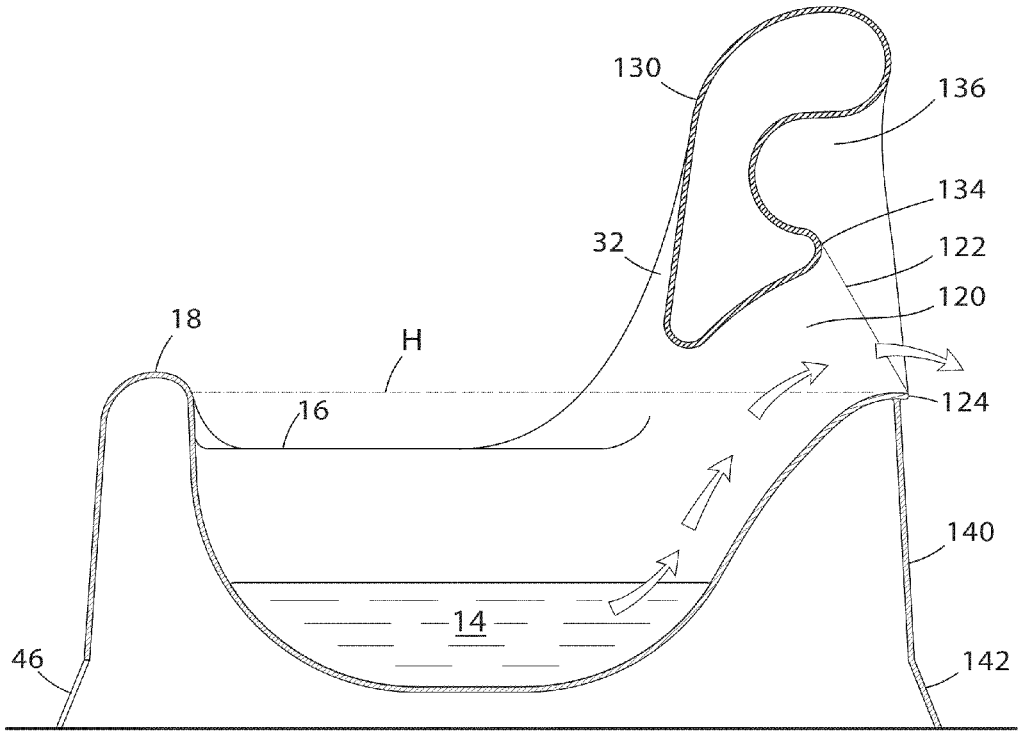
Figure 12:
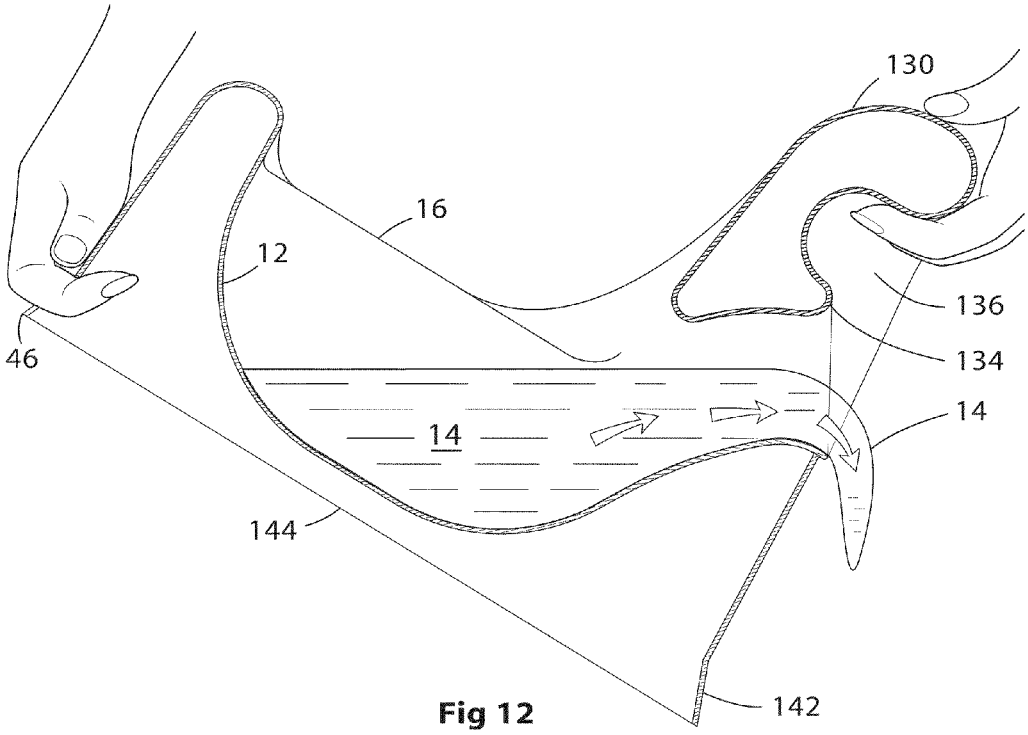

The rear surface of the backrest 130 is formed with a hand grip provided by an upper recess 136 forming a finger hold (FIGS. 11, 12), and a short dividing member 134 separates this upper recess from the discharge spout 120 below it. By shortening this dividing member 134 as compared with dividing member 34 (FIGS. 5, 6), the top of the discharge spout outlet 122 is brought somewhat back into the backrest, and the whole outlet 122, as indicated in FIG. 11, becomes more upwardly directed and less dimensionally restricted, allowing easier manual access to the interior of the discharge spout for cleaning and sterilizing purposes. The discharge spout has a rounded oval section, between about 100 mm and 140 mm in width, and between about 80 mm and 95 mm in height (measured perpendicularly to both the width and the central axis of the conduit) at its narrowest part. These dimensions afford an adult good access for cleaning, as well as good concealment from a child sitting on the potty and good control on emptying it.

The skirt 140 at the rear of the potty below the discharge outlet 122 is in this embodiment formed without any lower recess, so that the open outlet 122 of spout 120 lies above a generally flat area of the skirt 140, though still with the splayed foot portion 142. It is thus easy to wash, wipe clean, and dry.

The potty 110 is emptied in the same manner as potty 10 of the first embodiment.

Features of the first and second embodiments may be combined or interchanged or modified, to take advantage of their various benefits, in any convenient way. Thus, for example, it is possible to combine the larger opening dimensions of discharge spout of the second embodiment, for easier cleaning, with the longer dividing member 34 of the first embodiment, for enhanced splash protection on emptying, by providing a taller backrest 30/130 and elevating the position of the finger hold recess 36/136. Other changes and modifications within the scope of the invention will be apparent to those skilled in the art.

The invention claimed is:

1. A portable child's potty comprising a bowl, a seat, a backrest extending to a height above the seat, and a discharge spout having a rearward outlet behind the backrest, said discharge spout extending upwardly and rearwardly from the bowl under the backrest to the discharge spout outlet wherein, the discharge spout rises upwardly from the bowl, passing below the backrest, and terminates in an upwardly angled spout outlet.

2. A portable child's potty comprising a bowl, a seat, a backrest extending to a height above the seat, and a discharge spout having a rearward outlet behind the backrest, said discharge spout extending upwardly and rearwardly from the bowl under the backrest to the discharge spout outlet wherein, the discharge spout outlet is higher than the height of the bowl.

3. A potty according to claim 2 wherein the discharge spout outlet is higher than the seat.

4. A potty according to claim 1 wherein the discharge spout terminates at the said outlet in a downwardly inclined lower pouring lip.

5. A potty according to claim 1 wherein the backrest includes a hand grip above the discharge spout.

6. A potty according to claim 5 wherein the said hand grip is formed only in the rear of the backrest.

7. A potty according to claim 6 wherein the hand grip comprises a recess in the backrest forming a finger hold.

8. A potty according to claim 7 wherein the backrest is formed with a protective dividing member between the recess and the discharge spout.

9. A potty according to claim 1 wherein a hand grip is provided at the front of the potty.

10. A potty according to claim 9 where the said hand grip is formed in the outside of a front skirt to the bowl.

11. A potty according to claim 10 wherein the said hand grip comprises a recess forming a finger hold.

12. A potty according to claim 1 comprising a skirt on each side of the backrest extending rearwardly on each side of the rearward outlet to the discharged spout.

13. A potty according to claim 1 wherein the seat is formed on the rim of the bowl, and comprises at least one seat region located on each side of the bowl, forward of the backrest.

14. A potty according to claim 13 wherein the seat is interrupted at the front of the potty by a raised shield portion extending upwardly from the bowl.

15. A potty according to claim 1 wherein the backrest has a concave front surface, when viewed in plan.

16. A potty according to claim 1 comprising a supporting base formed by a level lower edge to a surrounding skirt.

17. A potty according to claim 1 formed in one piece.

18. A potty according to claim 17 moulded of plastics material.

19. A portable child's potty comprising a bowl for receiving toilet waste from a child user, a seat for supporting a child user over the bowl, a backrest extending to a height above the seat, and a rearward discharge spout extending upwardly from the bowl to a rearward discharge spout outlet behind the backrest, said discharge spout being adapted to permit toilet waste to be discharged from the bowl upon the potty being lifted and tilted backwards wherein, the discharge spout outlet is above the height of the seat.

20. A potty according to claim 19 wherein the discharge spout passes through the backrest between the bowl and the spout outlet.

21. A potty according to claim 19 provided with a front skirt to the bowl, wherein means for gripping the potty by hand for lifting the potty and tilting the potty backwards is provided at the front of the potty, said means comprising a recess in said skirt.

22. A potty comprising a bowl, a seat, a backrest extending to a height above the seat, and a rearward discharge spout extending from the bowl under the backrest to a spout outlet, wherein the spout outlet is higher than the height of the bowl.

23. A potty according to claim 22 provided with a front skirt to the bowl, wherein means for gripping the potty by hand for lifting the potty and tilting the potty backwards is provided at the front of the potty, said means comprising a recess in said skirt.

24. A potty comprising a bowl, a seat, a backrest extending to a height above the seat, and a rearward discharge spout extending from the bowl under the backrest, wherein the spout outlet is higher than the height of the bowl.

* * * * *